United States Patent [19]

Bracht et al.

[11] 4,110,877

[45] Sep. 5, 1978

[54] FLOATING TENSION TOOL AND STRAP LOCATING GUIDE APPARATUS AND METHOD

[75] Inventors: Donald L. Bracht, Seneca Falls; Harry R. Swank, Waterloo, both of N.Y.

[73] Assignee: GTE Sylvania Incorporated, Stamford, Conn.

[21] Appl. No.: 812,131

[22] Filed: Jul. 1, 1977

[51] Int. Cl.[2] ..... H01J 9/00

[52] U.S. Cl. ..... 29/25.13; 29/25.19; 100/32

[58] Field of Search ..... 100/32; 140/93.2; 29/25.13, 25.19

[56] References Cited

U.S. PATENT DOCUMENTS

| | | | |
|---|---|---|---|
| 2,785,820 | 3/1957 | Vincent et al. | 29/452 |
| 3,014,506 | 12/1961 | Crimmins | 140/93.2 |
| 3,367,374 | 2/1968 | Meier et al. | 140/93.2 |
| 3,456,076 | 7/1969 | Griswold et al. | 358/246 |
| 4,015,643 | 4/1977 | Cheung | 100/32 X |

*Primary Examiner*—Richard B. Lazarus
*Attorney, Agent, or Firm*—Thomas H. Buffton

[57] ABSTRACT

Apparatus for fabricating an implosion-resistant cathode ray tube envelope includes a support member for upholding the envelope and a tightening member movably affixed to the support member and having fixed and rotatable members formed to receive an over-lapping loop of metal strapping therebetween and responsive to activation of the rotatable member to exert a force on and effect movement of one portion of the metal strap in a given direction and exert force on and effect movement of the other portion of the metal strap and the tightening apparatus in a diametrically opposite direction. The metal strapping is positionally located on the envelope by a strap-locating guide. Also, a method for fabricating implosion-resistant cathode ray tube envelope includes the steps of placing an overlapping loop of metal strapping about the periphery of the envelope, positioning the overlapping loop of metal strapping in a strap tightening apparatus having a rotatable member mounted on a movable support and energizing the strap-tightening apparatus to activate the rotatable member and cause movement of one portion of the overlapping strap member in a given direction and movement of the other portion of the overlapping strap member and the movable strap tightening apparatus in an opposite direction.

19 Claims, 4 Drawing Figures

FLOATING TENSION TOOL AND STRAP LOCATING GUIDE APPARATUS AND METHOD

BACKGROUND OF THE INVENTION

The present invention relates to the fabrication of implosion-resistant cathode ray tubes and more particularly to implosion-resistant cathode ray tube fabrication utilizing prestressed metal band strapping.

An early form of implosion-resistant cathode ray tube employed a transparent implosion plate mounted immediately adjacent or bonded to the viewing portion of the cathode ray tube envelope. Obviously, such a technique is not only expensive of components and labor but also undesirably adds weight to the structure of receiver and has a deleterious effect upon light-transmitting characteristics of the tube faceplate.

Following, it was found that a prestressed metal strapping disposed about the periphery of the viewing panel of a cathode ray tube served to provide an implosion-resistant structure. Thus, the problems of properly tensioning the metal strapping in a repetitive manufacturing operation are encountered. Moreover, the tensioning problem is increasingly complex when one considers the now prevalent substantially rectangular-shaped cathode ray tube envelope in comparison with the previously popular rounded-shaped envelope.

In one known prior technique for tightening metal strapping about the periphery of the envelope of a substantially rectangular-shaped envelope, one end of the metal strapping is firmly attached to an immovable support and the other end of the metal strapping has a force exerted thereon. Thereafter, the metal strapping is attached therebetween to provide a banded metal strapping surrounding the envelope.

Although the above-described technique was and still is utilized to provide prestressed cathode ray tube envelopes, it has been found that the technique does leave something to be desired. For example, it has been found that a force exerted on one end of the wire strapping required the strap to be drawn about three corners of the rectangular-shaped envelope. As a result, it was found that the residual tension in the strapping often varied by as much as 200–250 pounds when a comparison was made between opposite sides of the envelope. Obviously, such a residual tension variation is undesirable.

Also, the metal strapping was commonly located positionally by a chute surrounding the envelope or by manual placement. However, the chute technique resulted in the metal strapping leaving the chute upon tightening which permitted an undesired change in position with respect to the envelope. Further, the manual placement technique is dependent upon operator accuracy which is usually less reliable than a mechanical operation. Moreover, a manual operator is susceptible to injury in case of breakage of the metal strapping during application.

OBJECTS AND SUMMARY OF THE INVENTION

An object of the present invention is to enhance band strapping a cathode ray tube envelope. Another object of the invention is to provide an improved prestressed metal band strapped cathode ray tube envelope. Still another object of the invention is to provide improved apparatus for band strapping a cathode ray tube. A further object of the apparatus is to improve the method of band straping a cathode ray tube.

These and other objects, advantages and capabilities are achieved in one aspect of the invention by cathode ray tube implosion-resistant structure fabricating apparatus having a support member upholding a cathode ray tube envelope and a tightening member having a fixed member and a rotating member formed to receive an overlapping loop of metal strapping therebetween with the metal strapping surrounding the envelope and the rotatable member responsive to activation to effect movement of one portion of the metal strapping in a given direction and effect movement of the other portion of the over-lapped metal strap and tightening member in an opposite direction. The metal strapping is positionally located by a locating guide member.

In a process for fabricating an implosion-resistant cathode ray tube envelope, an over-lapping loop of metal strapping is placed about the periphery of the envelope and positioned intermediate fixed and rotatable members of a movable strap-tightening member which is energized to activate the rotatable member causing movement of one portion of the over-lapping metal strapping in a given direction and movement of the other portion of the metal strapping and the tightening member in an opposite direction.

PREFERRED EMBODIMENT OF THE INVENTION

For a better understanding of the present invention, together with other and further objects, advantages and capabilities thereof, reference is made to the following disclosure and appended claims in conjunction with the accompanying drawings.

Figure 1:
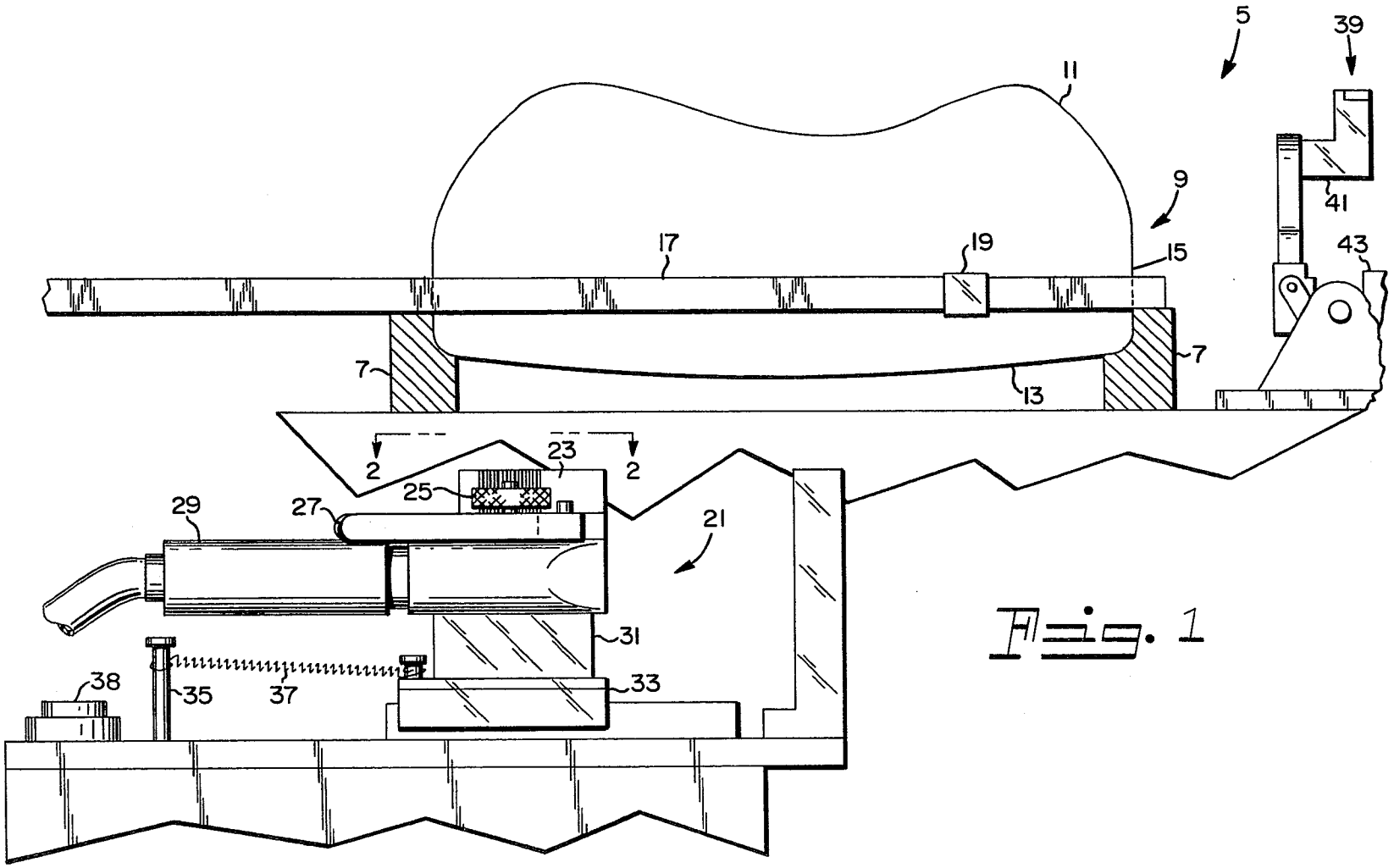
FIG. 1 is an elevational view illustrating a preferred form of cathode ray tube envelope implosion-resistant structure fabricating apparatus.

Referring to the drawings, FIG. 1 illustrates a metal strapping apparatus or an implosion-resistant cathode ray tube structure fabricating apparatus 5. The metal strapping apparatus 5 includes a plurality of support members 7 disposed about the periphery of a face plate 9 of a cathode ray tube 11. The face plate 9 has a viewing portion 13 and a non-viewing region 15. An overlapping loop of metal strapping 17 is placed in surrounding relationship of the non-viewing region 15 of the cathode ray tube 11 and a clip member 19 is loosely slipped over adjacent portions of the over-lapping loop of metal strapping 17.

Figure 2:
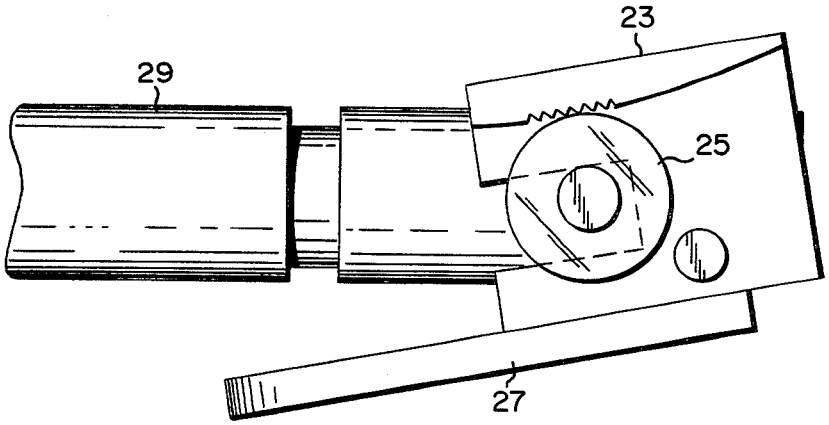
FIG. 2 is a plan view taken along the line 2—2 illustrating a portion of the fabricating apparatus of FIG. 1.

The metal strapping apparatus 5 also includes a metal strap tightening member 21. The tightening member 21 includes a serrated fixed member 23 and a knurled rotatable member 25. As can be seen in FIG. 2, the serrated fixed member 23 is pivotable and includes an extension member 27 for positioning the fixed member 23 in a manner such that the over-lapping loop of metal strapping 17 may be disposed intermediate thereto and the knurled rotatable member 25. Moreover, the rotatable member 25 is connected to a controllable air pressure source 29 whereby tensional force exerted by the rotatable member 25 is controllable.

Also, the fixed and rotatable members 23 and 25 of the strap tightening member 21 are affixed to a support member 31. The support member 31 is loosely attached to a slide assembly 33 which is affixed to a fixed post member 35 by a resilient means or spring 37. A pivot member 38 permits movement of the complete tightening member 21, support member 31 and slide assembly 33 to accommodate different sizes of cathode ray tube 11. Thus, the loosely affixed support member 31 permits the fixed and rotatable members 23 and 25 to move in a manner such that the fixed member 23 contacts and lays substantially flat against the face plate 9. Moreover, the fixed and rotatable members 23 and 25 are movable in response to activation of the rotatable member 25 as will be explained herinafter.

Additionally, a locating guide member 39 includes a finger member 41 pivotably associated with an air cylinder 43. The locating guide member 39 is positionally located adjacent a support member 7 of the strapping apparatus 5 and includes a 90° angular movement capability of the finger member 41 in response to energization of the air cylinder 43. Moreover, the air cylinder 43 is connected and operates in conjunction with an air cylinder (not shown) for indexing the strap tightening member 21 into the operational position.

Figure 3:
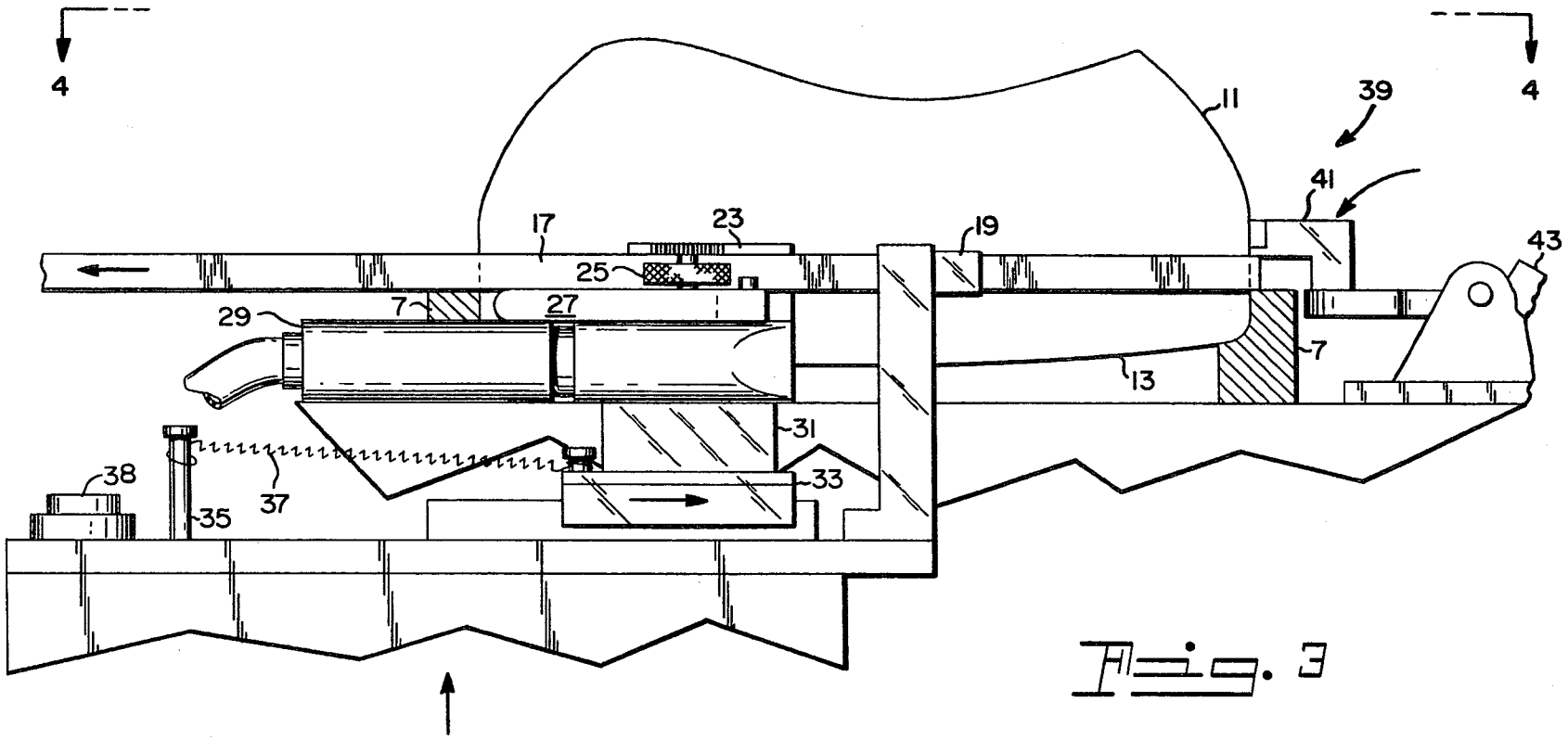
FIG. 3 is a side elevational view of the cathode ray tube envelope implosion-resistant structure fabricating apparatus of FIG. 1.
Figure 4:
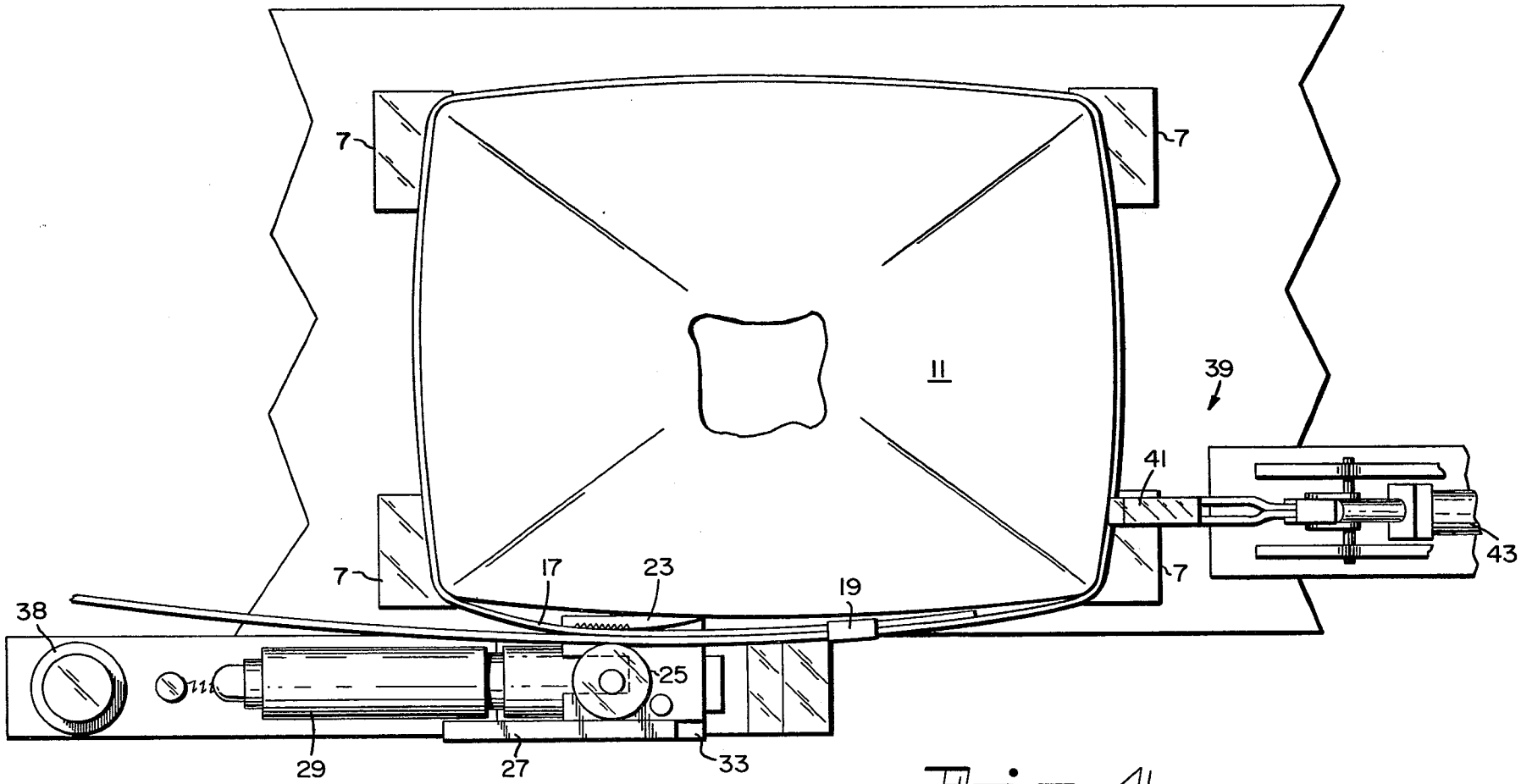
FIG. 4 is a plan view of the cathode ray tube envelope implosion-resistant structure fabricating apparatus of FIG. 1.

Referring to the operation of the apparatus and FIGS. 3 and 4 of the drawings, the over-lapping metal strapping 17 is formed into a loop which is placed in surrounding relationship to the non-viewing region 15 of the faceplate 9 which has been positioned upon the support members 7. A clip member 19 is loosely affixed to the over-lapping portion of the metal strap 17. Thereafter, the air cylinder 43 and an air cylinder (not shown) are activated whereupon the strap tightening member 21 indexes in a manner which places the fixed and rotatable members 23 and 25 adjacent the metal strapping 17. Also, the locating guide member 39 is activated causing the finger member 41 to rotate and force the metal strapping 17 intermediate thereto and the support member 7. Thus, the metal strapping 17 is consistently and uniformly positioned at a given location on the face plate 9 by the locating guide member 39.

Following, the extension member 27 is activated to provide a space for deposition of the over-lapping loop of metal strapping 17 intermediate the fixed and rotatable members 23 and 25 of the strap tightening member 21. Then, the rotatable member 25 is energized from the controlled air pressure source 29 whereupon the rotatable member 25 causes one portion of the over-lapping loop of metal strapping 17 to move in a given direction.

As the metal strapping 17 begins to tighten due to the activation of the rotatable member 25, the loosely attached fixed member 23 is pivoted and rides along the contour of the face plate 9. The force exerted intermediate the fixed and movable members 23 and 25 causes the strap tightening member 21 to move along the slide assembly 33 in a direction diametrically opposite from the direction of movement of the one portion of the overlapping strap member 17. As a result, the other portion of the over-lapping strap member 17 is caused to move in the same direction as the tightening member 21 i.e. in a direction opposite from the direction of movement of the one portion of the metal strapping 17. Thus, opposite forces are exerted on both over-lapping portions of the metal strapping 17.

Thereafter, the clip member 19 is crimped to maintain the tensional force exerted by the metal strapping 17 on the face plate 9. The fixed and rotatable members 23 and 25 are released from the metal strapping 17 and returned along the slide assembly 33 by the force exerted by the spring 37. Also, the air cylinder 43 and the air cylinder (not shown) are activated to cause the finger member 41 of the locating guide 39 to be rotated about 90° and the strap tightening member 21 to be indexed out of the operational location.

In summary, the face plate 9 is placed on the support members 7, the over-lapping loop of metal strapping 17 is placed about the periphery of the face plate 9, and a clip member 19 is loosely affixed to the metal strapping 17. The air cylinder 43 and an air cylinder (not shown) are activated to cause the strap tightening member 21 to index into position and the locating guide member 39 to rotate and positionally locate the strap member 17. Then, the over-lapping portions of the metal strap 17 are located intermediate the fixed and rotatable members 23 and 25 and the rotatable member 25 energized from the controlled air pressure source 29. Thereupon, the fixed member 23 is forced against the face panel 9, one portion of the strap member 17 advances in a given direction and the strap tightening member 21 advances in an opposite direction exerting a force in that direction on the other portion of the metal strapping 17.

Thus, there has been provided a unique apparatus and method for fabricating an implosion-resistant cathode ray tube structure. The technique and apparatus serves to exert oppositely directed forces upon the over-lapping metal strapping thereby drawing the metal around both front corners of a rectangular-shaped structure. Thus, the tensional force is more evenly distributed and resultant residual tensional differences of 200–250 lbs are no longer encountered.

Also, the metal strap guide member can uniformly locate the metal strapping within a very limited range in a consistent and repeatable manner. Moreover, the guide member serves as a protective device for absorbing the energy of a broken strap whenever such an event occurs. Since the straps usually break in the vicinity of the clip member, the energy of the tensioned strap is dissipated in the guide member whereby the safety of an operator is greatly enhanced.

While there has been shown and described what is at present considered the preferred embodiments of the invention, it will be obvious to those skilled in the art that various changes and modifications may be made therein without departing from the invention as defined by the appended claims.

What is claimed is:

1. An implosion-resistant cathode ray tube fabricating apparatus for a cathode ray tube having an envelope with a funnel portion and a viewing portion with a non-viewing region surrounded by an over-lapping loop of metal strapping, said apparatus comprising:

a support means for upholding said envelope in a predetermined positional location; and a tightening means slidably affixed to said support means and including fixed and rotatable members with said rotatable member coupled to means operable to effect rotation, said fixed and rotatable members having means to receive said overlapping loop of metal strapping therebetween and operation of said rotational member exerting a force on and effecting movement in a given direction of one overlapping portion of said metal strapping and causing exertion of a substantially equal and opposite force on and movement in a diametrically opposite direction of said tightening means and said other overlapping portion of said metal strapping whereby substantially equal tensional forces are exerted in opposite directions on said overlapping portions of said metal strapping.

2. The apparatus of claim 1 including a locating guide member affixed to said support means and operable for confining said metal strapping intermediate thereto and said support means whereby said metal strapping is properly positioned on said non-viewing region of said viewing portion of said cathode ray tube envelope.

3. The apparatus of claim 1 wherein said rotatable member of said tightening means is of a form responsive to energization by an air cylinder energy source.

4. The apparatus of claim 1 wherein said fixed and said rotatable members of said tightening means each include a knurled portion formed to receive an overlapping loop of metal strapping therebetween.

5. The apparatus of claim 1 including a resilient force means coupling said tightening member to said support means to effect a resistant and resilient opposition to movement of said tightening means in response to activation of said rotatable member.

6. The apparatus of claim 2 wherein said locating guide member includes at least one member adjacent the periphery of said envelope and responsive to energization to move in an arc-like manner to confine said metal strapping intermediate thereto and said support member.

7. Apparatus for affixing an overlapping loop of metal strapping to the non-viewing region of the viewing portion of a cathode ray tube envelope to provide an implosion-resistant structure comprising:

means for supporting said cathode ray tube envelope in a predetermined positional location;

means for tightening said overlapping loop of metal strapping movably mounted on said means for supporting said cathode ray tube envelope, said tightening means including fixed and rotatable members with said rotatable member coupled to means operable to effect rotation and said fixed and rotatable members having means to receive said overlapping loop of metal strapping therebetween, said rotatable member responsive to said means operable to effect rotation to effect movement in a given direction of one overlapping portion of said metal strapping and cause movement in a diametrically opposite direction of said means for tightening said overlapping loops of metal strapping and the other overlapping portion of said metal strapping; and means affixed to said overlapping loop of metal strapping for clamping said strapping to maintain a compressive force exerted thereby on said non-viewing region of said viewing portion of said cathode ray tube envelope.

8. The apparatus of claim 7 including a means for locating said over-lapping loop of metal strapping with respect to said support means and said cathode ray tube.

9. The apparatus of claim 7 including means affixed to said means for supporting said cathode ray tube and to said means for tightening said over-lapping loop of metal strapping for exerting a force therebetween to inhibit advancement and enhance return of said means for tightening said over-lapping loop of metal strapping.

10. The apparatus of claim 7 wherein said rotatable member of said means for tightening said over-lapping loop of metal strapping is energized by an air cylinder source.

11. The apparatus of claim 7 wherein said fixed member includes a serrated portion and said rotatable member of said means for tightening said over-lapping loop of metal strapping includes a knurled portion formed for contact with said metal strapping.

12. The apparatus of claim 8 wherein said means for locating said over-lapping loop of metal strapping is in the form of a locating guide operable in an arc-like movement to effect contact with said metal strapping and confine said metal strapping intermediate thereto and said means for supporting said cathode ray tube.

13. The apparatus of claim 8 wherein said means for locating said over-lapping loop of metal strapping is in the form of a locating guide operable in an arc-like movement in response to air cylinder energization to confine said metal strapping intermediate thereto and said means for supporting said cathode ray tube.

14. The apparatus of claim 8 wherein said means for locating said over-lapping loop of metal strapping is in the form of at least one locating guide disposed about the periphery of said cathode ray tube and operable in a manner to confine the metal strapping intermediate thereto and said means for supporting said cathode ray tube.

15. A method of fabricating an implosion-resistant cathode ray tube envelope having a funnel portion and a viewing portion connected by a non-viewing region to the funnel portion comprising the step of depositing a cathode ray tube envelope onto a support member in a given positional location;

placing an overlapping loop of metal strapping about the non-viewing region of said viewing portion of said cathode ray tube envelope;

positioning said overlapping loop of metal strapping intermediate fixed and rotatable members of a tightening member movably mounted on said support member, said rotatable member being coupled to an energizing source; and activating said rotatable member from said energizing source to cause one portion of said loop of metal strapping to advance in a given direction and said tightening member and other portion of said loop of metal strapping to advance in a diametrically opposite direction whereby a substantially equal tensional force is exerted in opposite directons on the loop portions of the metal strapping.

16. The method of claim 15 including the step of affixing said viewing portion of said cathode ray tube envelope to apparatus which includes said strap-tightening member and a support member.

17. The method of claim 15 including the step of clamping said over-lapping loop of metal strapping to maintain said substantially uniform tightening forces exerted on both portions of said metal strapping.

18. The method of claim 16 including the step of activating a strap locating guide to effect contact with said over-lapping loop of metal strapping and cause said metal strapping to be located intermediate thereto and said strap support member.

19. The method of claim 16 wherein said viewing portion of said cathode ray tube envelope is substantially rectangular-shaped and the tensional forces exerted on said metal strapping at diametrically opposite sides of said envelope are substantially equal.

* * * * *